US008568568B2

(12) United States Patent
Schuecker et al.

(10) Patent No.: US 8,568,568 B2
(45) Date of Patent: Oct. 29, 2013

(54) LEVELING APPARATUS FOR AND METHOD OF FILLING AN OVEN CHAMBER OF A COKE-OVEN BATTERY

(75) Inventors: Franz-Josef Schuecker, Castrop-Rauxel (DE); Peter Thomas, Erkelenz (DE)

(73) Assignee: UHDE GmbH, Dortmund (DE)

( * ) Notice: Subject to any disclaimer, the term of this patent is extended or adjusted under 35 U.S.C. 154(b) by 650 days.

(21) Appl. No.: 12/740,996

(22) PCT Filed: Nov. 6, 2008

(86) PCT No.: PCT/EP2008/009370

§ 371 (c)(1),
(2), (4) Date: Jul. 26, 2010

(87) PCT Pub. No.: WO2009/068161

PCT Pub. Date: Jun. 4, 2009

(65) Prior Publication Data

US 2010/0276269 A1 Nov. 4, 2010

(30) Foreign Application Priority Data

Nov. 28, 2007 (DE) ..... 10 2007 057 348

(51) Int. Cl.
*C10B 37/02* (2006.01)

(52) U.S. Cl.
USPC ..... 201/1; 201/40; 201/41; 202/248; 202/251; 202/262; 202/270

(58) Field of Classification Search
CPC ..... C10B 37/02
USPC ..... 201/1, 40, 41; 202/248, 251, 262, 270
See application file for complete search history.

(56) References Cited

U.S. PATENT DOCUMENTS 6,587,073 B2 * 7/2003 Schiek et al. ..... 342/124
7,617,873 B2 * 11/2009 Lovell et al. ..... 166/305.1

FOREIGN PATENT DOCUMENTS

JP 03000796 A * 1/1991
JP 10008062 A * 1/1998
JP 2005239787 A * 9/2005
WO WO 2008028991 A1 * 3/2008

* cited by examiner

*Primary Examiner* — Nina Bhat
*Assistant Examiner* — Jonathan Miller
(74) *Attorney, Agent, or Firm* — Andrew Wilford

(57) ABSTRACT

A coking oven has a battery of longitudinally extending and transversely spaced coking chambers each provided with a plurality of downwardly open and longitudinally spaced filling holes. Coal is charged into the chambers through the respective filling holes. A respective longitudinally movable leveling rod in each of the chambers can level coal charged by the filling equipment into the chambers. Sensors provided on the leveling rods scan from above transversely and longitudinally spaced points on a surface of the coal charged through the holes into the respective chambers. A controller connected to the sensors records a respective measurement corresponding to a vertical position of the surface at each the points and determines from the measurements thereof a three-dimensional filling-level profile of the surface of the charged coal for controlling operation of the filling equipment and filling of the chambers with the coal.

9 Claims, 2 Drawing Sheets

LEVELING APPARATUS FOR AND METHOD OF FILLING AN OVEN CHAMBER OF A COKE-OVEN BATTERY

CROSS REFERENCE TO RELATED APPLICATIONS

This application is the US-national phase of PCT application PCT/EP2008/009370, filed 6 Nov. 2008, published 4 Jun. 2009 as WO2009/068161, and claiming the priority of German patent application 102007057348.2 itself filed 28 Nov. 2007, whose entire disclosures are herewith incorporated by reference.

FIELD OF THE INVENTION

The invention relates to a method of filling an oven chamber of a coke-oven battery, where by means of at least one sensor arranged on a leveling rod, and by means of a controller connected to the sensor, the profile of the bulk material within the oven chamber during the filling process is determined, and where depending on the determined profile of the bulk material an additional loading of the oven chamber takes place. Subject matter of the invention is in addition a leveling apparatus for carrying out the method.

In coking plants, the oven chambers of a coke-oven battery are filled through filling holes by a filling machine arranged moveable on the coke-oven battery. For this, the loading of the individual filling holes is typically carried out via allocated, speed-controlled screw-conveyors that fill the coking coal through coal funnels into the oven chamber. The design of the screw-conveyors and the setting for the developing of the rotational frequency of the screw during the filling cycle are particularly dependent on the volume of the oven chambers, the aimed filling time, the filling sequence of the different oven chambers of a coke-oven battery, and the size of the coal funnel of the filling machine. To evenly distribute the coking coal of the bulk material cone formed during filling, a leveling apparatus is provided comprising a leveling rod that is introduced in an upper region of the oven chamber through a leveling opening in an oven chamber door and is moved in the longitudinal direction of the oven chamber.

From practice is known to determine the filling levels underneath the filling holes during the start up of the filling machine, obtained with an initial setting for the developing of the screw frequency, and to estimate therefrom the filling degree, wherein on the basis of the estimation, an adjustment of the screw-frequency takes place to achieve an improved coal charge. The determined settings provide a basis for the continuous operation of the coke-oven battery and can be checked by repeated measurements of the filling level underneath the filling holes, or by determination of the coke cake profile at ejection.

A method of filling an oven chamber of a coke-oven battery comprising the above mentioned features is known from DE 10 2005 007 164 A1, wherein the sensor comprising a contact sensor is arranged on the head of the leveling rod. The sensor detects the contact-making and the contact-losing with a bulk material discharge cone formed by the filled coking coal. From the measurement signals, the bulk material filling progress is determined by the controller, wherein based on this information, an additional loading of the oven chamber can take place. Thereby the bulk material filling progress can only be determined, when the formed bulk material cones have reached the level of the leveling rod, and the oven chamber is already filled to a large extent. In addition, the accuracy of the described method needs to be improved because the exact shape of the bulk material cone can not be determined based on the signals of the contact sensor. Thus, the steepness of the individual bulk material cones can greatly depend on the size distribution and the surface structure of the coking coal used for coking and can not by implication be predetermined.

From the publication DE 10 2005 010 114 A1, which relates to a method and a system for controlling an operating unit of a coke oven, is known to determine the filling level during the filling cycle underneath the filling holes of an oven chamber. On the basis of the information determined in that way, the bulk material filling progress in longitudinal direction can only be estimated roughly because the exact filling level between the individual filling holes is not known. Furthermore, the profile of the coke cake surface can be determined at the ejection, wherein from the obtained data, the bulk material progress profile previously achieved during the filling of the oven chamber and the filling level can only be determined with some uncertainty because of the shrinkage behavior of the coking coal during the coking process. Furthermore, based on the downstream evaluation of the coke cake profile, only the adjustment of a subsequent filling is possible, wherein a consideration and a compensation of variations during the filling, which are not completely reproducible, is impossible.

OBJECT OF THE INVENTION

Against this background, the invention is based on the problem to provide a method of filling an oven chamber of a coke-oven battery, by means of which a uniform bulk material discharging progress and an increase of the filling degree of the oven chamber can be achieved.

SUMMARY OF THE INVENTION

Based on a method comprising the above described features the problem is solved according to the invention in that by the at least one sensor, in longitudinal direction and transverse direction of the oven chamber, a three-dimensional filling level profile is determined contactless. By the determination of the three-dimensional filling level, the uniformity of the bulk material filling progress, and the filling degree can exactly be determined directly during the filling. By the direct evaluation by the controller, the additionally added volume of coking coal can then be calculated continuously, wherein depending on the actually determined filling profile and volume, a control of the filling process according to the requirements is possible. For example, in a filling device, screw-conveyors can be provided that are allocated to one filling hole of the oven chamber, respectively, and the rotational frequencies of the screws in each case are controlled independently from each other. In doing so, an empty volume remaining for the maximum filling can only be determined without restriction for a region of the oven chamber that was just passed by the sensor, or for the whole oven chamber. With a fast evaluation of the measurement signals, thus a direct, continuous adjustment of the control signals during the filling process is also possible.

By the contactless determination of the three-dimensional filling level profile, an accurate control is possible at an early stage during the filling cycle. In the embodiment known from DE 10 2005 007 164 A1, a filling underneath one of the filling holes that is too high or too low, is recognized only upon contact of the respective bulk material discharge cone with the leveling rod, wherein then, by an adjusted control of the frequencies of the screw-conveyors, or a repeated leveling with the leveling rod, a substantial delay of the filling cycle can occur. In contrast to that, according to the invention, the profile of the bulk material can be determined early with a very high accuracy, and a uniform filling can be ensured so that within a comparatively short filling time, an optimal filling can be realized. Since the sensor operates contactless, the risk of wear by mechanical stress can also be minimized.

The contactless determination of the filling level profile with the sensor can be carried out, for example, by laser beams, microwaves, and/or ultrasound by at least one measuring beam or a bundle of measuring beams. The sensor can be arranged without restriction at a leveling section formed as, for example, a rake blade at the front end of the leveling rod, or at a support section of the leveling rod adjacent thereto. The position of the sensor can be determined in a particularly simple manner from the leveling rod's path signal that, for example, is provided by a control of the leveling rod, a central control unit, or a path sensor arranged on the leveling rod.

During the three-dimensional determination of the bulk material discharge progress by the controller, typically a determination of the filling level at discrete points, which in longitudinal direction and transverse direction of the oven chamber form a grid, takes place, wherein the intermediate values can be determined by interpolation. In doing so, the bulk material filling progress in transverse direction is preferably determined directly up to the border of the oven chamber to be able to determine the filling volume as accurate as possible, wherein advantageously across the width of the oven chamber in the transverse direction and the distance between two filling holes of the oven chamber in longitudinal direction, at least five grid points are provided, respectively. However, preferably, a finer spacial resolution is provided, wherein a resolution that is below the typical grid size of the filled coking coal is in fact possible with suitable measuring systems, but is typically not required. Optionally, the distance to the ceiling of the oven chamber can additionally be determined and can be considered for the control of the filling and/or as a monitor for the correct positioning of the leveling rod.

While in the methods for filling an oven chamber of a coke-oven battery known from the prior art, the leveling rod always is moved in a predetermined manner, in a further development of the present invention can be provided that the leveling rod is positioned by the controller depending on the determined three-dimensional filling level profile in longitudinal direction of the oven chamber, whereby the filling time can further be reduced and the result of the filling can be improved.

Within the scope of a preferred embodiment is provided that on the leveling rod at least two sensors are arranged that are operating contactless and are spaced apart from each other in longitudinal direction of the leveling rod. With a plurality of sensors that are spaced apart, at different positions in the longitudinal direction of the oven chamber, filling level profiles can be determined in transverse direction at the same time so that during filling, an overall improved accuracy of the determination of the filling progress can be achieved, in particular because during the filling process, the filling level in the different areas of the oven chamber changes constantly. Moreover, even in case of a breakdown of a sensor or a portion of the sensors, via the sensors still remaining functional, a determination of the profile of the bulk material is possible, however with a reduced accuracy.

In spite of the temperatures prevailing inside the oven chamber, the aggressive gas components of the coke gas formed inside the oven chamber, and the particulate solids contained in the coke gas, within the scope of the method according to the invention, a reliable operation of the sensor that functions contactless and that is introduced directly into the oven chamber together with the leveling rod is surprisingly possible. To further increase the reliability of the method according to the invention, a cleaning device for the at least one sensor can be provided. Thus, the sensor can be flushed during the filling process with a separately supplied flushing medium, for example air. In addition, or alternatively, between the filling cycles of the different oven chambers of a coke-oven battery, a chemical and/or mechanical cleaning of the at least one sensor can also be provided. Finally it is also possible to arrange parts of the at least one sensor on the leveling rod such that, during the filling cycle, they are still arranged outside of the oven chamber. Thus, the sensor can comprise, for example, mirrors, fiber optics, hollow wave guides, or the like, wherein electronic components of the sensor during the operation of the leveling apparatus are located outside of an oven chamber to be filled.

Subject matter of the invention is in addition a leveling is apparatus for carrying out the previously described method.

BRIEF DESCRIPTION OF THE DRAWING

The invention is explained hereinafter by a drawing illustrating only one embodiment. In the figures

DETAILED DESCRIPTION OF THE INVENTION

Figure 1:
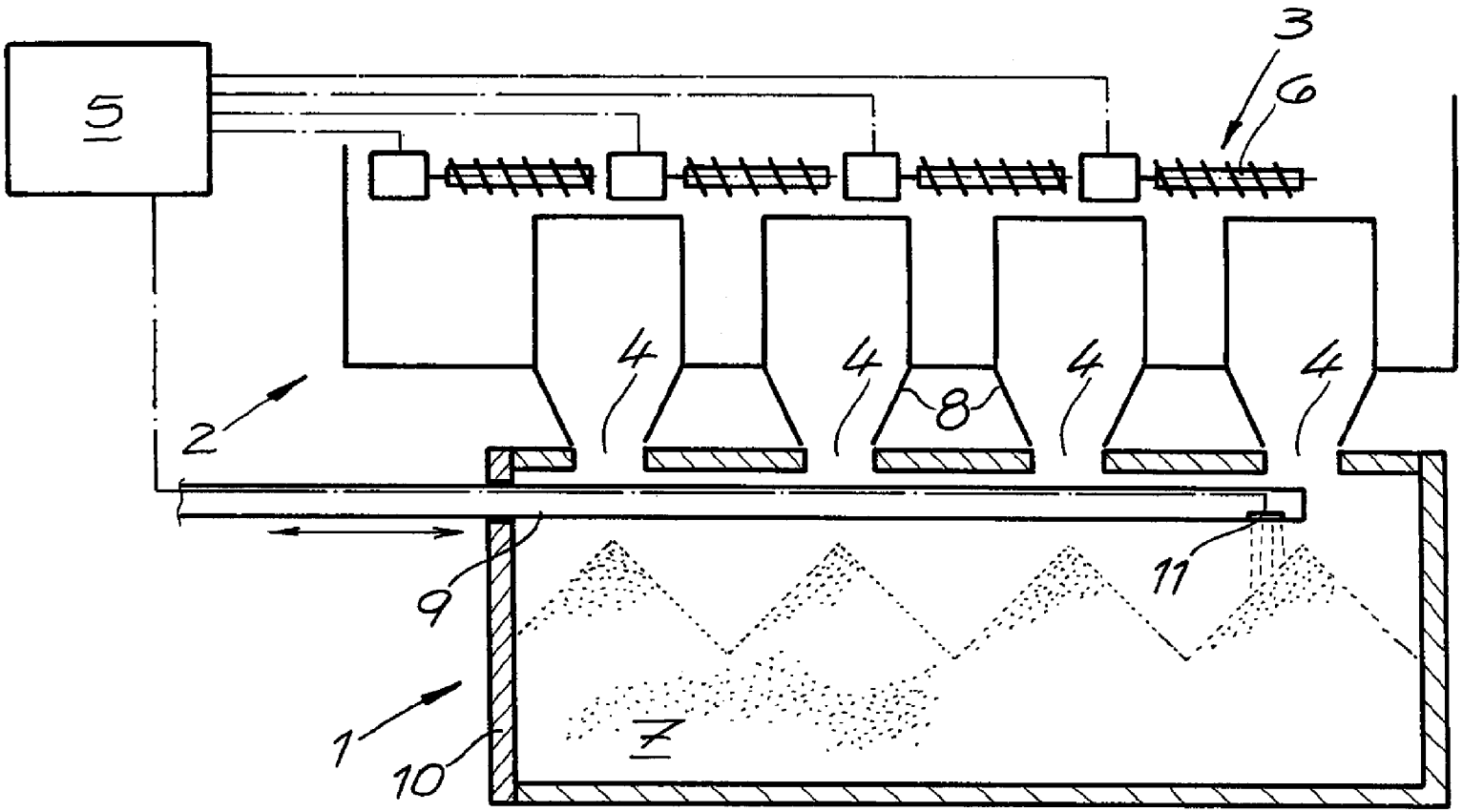
FIG. 1 is a schematic horizontal section through an oven chamber of a coke-oven battery during the filling process.

In FIG. 1, an oven chamber 1 of a coke-oven battery is illustrated during a filling cycle. For this, a filling machine 2 is provided that is movable on the coke-oven battery and that comprises a plurality of conveyors 3, each of them allocated to a respective filling hole 4 of the oven chamber 1. The conveyors 3 each comprise an auger 6 that is speed-controlled and connected to a shared controller 5, and that conveys the coking coal 7 via a coal funnel 8 into the allocated filling hole 4. To achieve a uniform distribution of the coking coal 7 within the oven chamber 1, a leveling rod 9 is introduced into the oven chamber 1 through a leveling opening in a lateral oven chamber door 10 and moved in and out in longitudinal direction. At the front end of the leveling rod 9, a sensor 11 is arranged that operates contactless and that is connected to the controller 5, and by means of which, a three-dimensional filling level profile is determined in longitudinal and transverse direction. From the filling level profile determined for a portion of the oven chamber 1 or the entire oven chamber 1, it is continuously calculated which volume of coking coal 7 is to be added to achieve an optimum filling, wherein by means of the controller 5, a corresponding control of the individually addressable screw conveyors 3 takes place.

As shown in FIG. 1, the filling level can be determined with the sensor 11 already at an early stage, before the individual bulk material discharge cones formed underneath the filling holes 4 reach the level of the leveling rod 9. In particular, by the three-dimensional scanning of the surface of the bulk material charge up to the border of the oven chamber 1, the steepness of the individual bulk material cones longitudinally and transversely and also an offset of the bulk material discharge cones longitudinally and transversely are exactly determinable. From the measurement values of the sensor 11, the volume of the already filled coking coal 7 and the quantity required for an additional loading can be determined accurately. Thus, a uniform filling can be achieved already at an early stage so that the filling time can be reduced.

Figure 2:
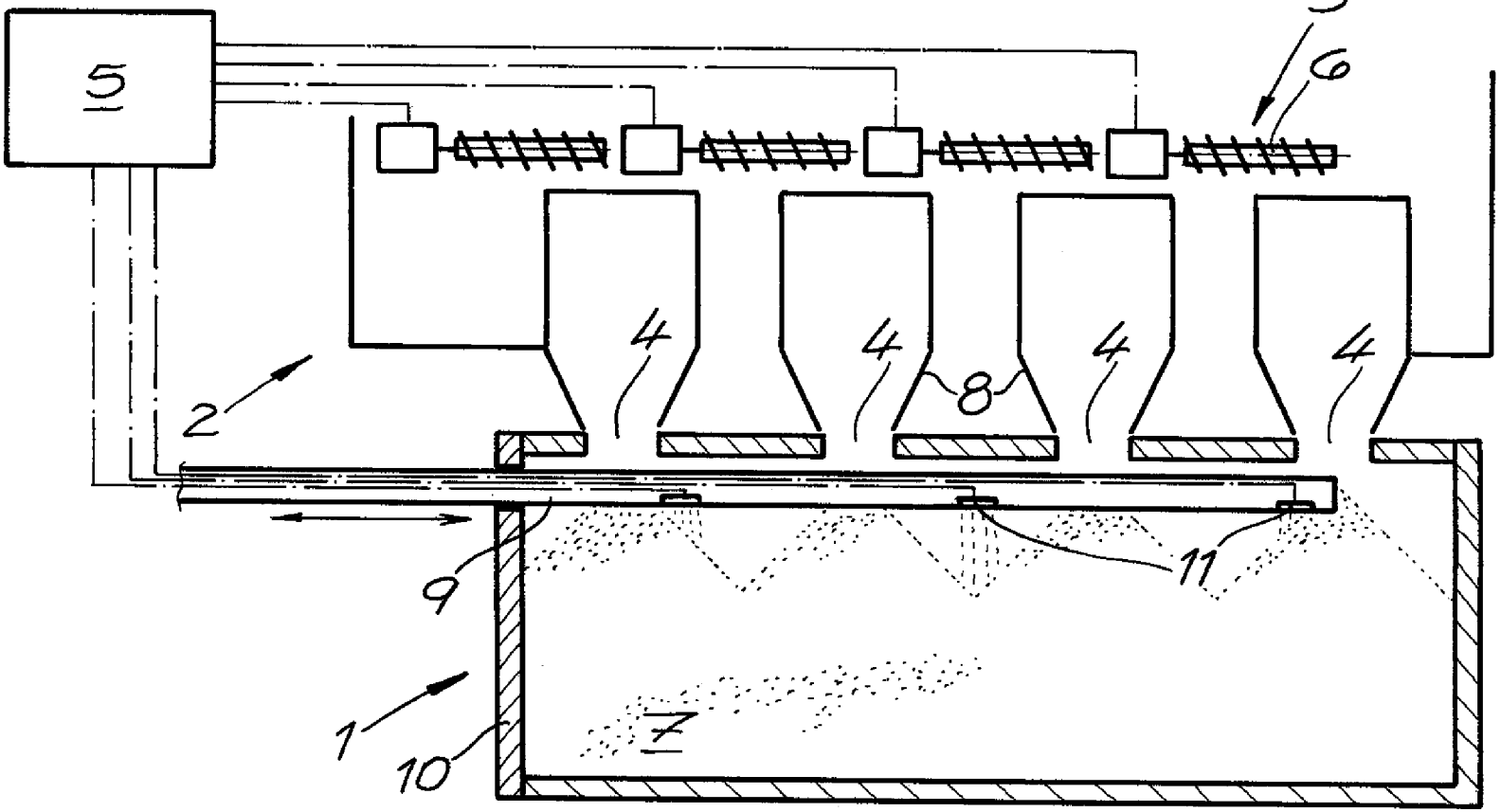
FIG. 2 shows the arrangement of FIG. 1 in an alternative embodiment.

FIG. 2 shows an embodiment in which, in contrast to FIG. 1, three sensors 11 are arranged equally spaced apart from each other on the leveling rod 9. By means of the three sensors 11, at different positions in the longitudinal direction of the oven chamber, filling level profiles can be recorded transversely at the same time so that the measuring accuracy can be further increased. In particular, even in case of a breakdown of one of the sensors 11, a determination of the filling level is still possible in an emergency operation of the sensors 11 still remaining functional.

While in the embodiments known from the prior art, the leveling rod 9 is moved in and out in a predetermined manner, the is leveling rod 9, according to the invention, can be variably positioned longitudinally of the oven chamber 1 during the filling cycle, depending on the determined three-dimensional filling level profile.

The determination of the filling level profile by the sensor (s) 11 can take place, for example, by laser beams, microwaves and/or ultrasound. By the contactless determination of the filling level, in addition, mechanical wear of the sensor 11 is avoided. To increase the reliability of the sensor 11, it can be cleaned or protected against pollution by a cleaning device. Moreover, in addition, sensitive parts of the sensor 11 can be arranged such that they are located outside of the oven chamber during the leveling process while filling.

The invention claimed is:

1. In a method of charging a coking oven having a battery of longitudinally extending and transversely spaced coking chambers each provided with a plurality of downwardly open and longitudinally spaced filling holes and with a respective longitudinally movable leveling rod, coal being charged by transversely traveling filling equipment into the chambers through the filling holes and leveled therein by the respective rods, the improvement comprising the steps of:

with sensors provided on the leveling rods, scanning from above points on a surface of the coal charged through the holes into the respective chambers, the points being transversely and longitudinally spaced to form a grid with the points transversely spaced such that there are at least five of the points between each of the filling holes and a transversely adjacent filling hole of an adjacent chamber and longitudinally between two adjacent filling holes of the same chamber; and recording a respective measurement corresponding to a vertical position of the surface at each the points of the grid; and with a controller connected to the sensors, determining from the measurements thereof a three-dimensional filling-level profile of the surface of the charged coal for controlling operation of the filling equipment and filling of the chambers with the coal.

2. The method according to claim 1, further comprising the steps of:

with the controller, calculating from the three-dimensional filling level profile, an empty volume remaining for maximum filling for a section of the oven chamber or the entire oven chamber, and subsequently loading the section of the chamber or the entire chamber with a corresponding additional filling quantity during the filling process.

3. The method according to claim 1, further comprising the step of:

positioning the leveling rod longitudinally of the oven chamber by the controller depending on the determined three-dimensional filling level profile.

4. The method according to claim 1 wherein the filling equipment comprises a plurality of conveyors each allocated to a respective one of the filling holes of the oven chamber and controlled independent from each other by the controller.

5. An apparatus for charging coal into a coking oven having a battery of longitudinally extending and transversely spaced coking chambers each provided with a plurality of downwardly open and longitudinally spaced filling holes, the apparatus comprising:

filling transversely traveling equipment for charging coal into the chambers through the respective filling holes;

a respective longitudinally movable leveling rod in each of the chambers for leveling coal charged by the filling equipment into the chambers through the filling holes;

sensors provided on the leveling rods for scanning from above points on a surface of the coal charged through the holes into the respective chambers, the points being transversely and longitudinally spaced to form a grid with the points transversely spaced such that there are at least five of the points between each of the filling holes and a transversely adjacent filling hole of an adjacent chamber and longitudinally between two adjacent filling holes of the same chamber; and control means connected to the sensors for recording a respective measurement corresponding to a vertical position of the surface at each the points of the grid and for determining from the measurements thereof a three-dimensional filling-level profile of the surface of the charged coal for controlling operation of the filling equipment and filling of the chambers with the coal.

6. The leveling apparatus according to claim 5, wherein the sensor is developed as a laser sensor.

7. The leveling apparatus according to claim 5 wherein each leveling rod has at least two of the sensors that operate contactlessy and are spaced apart from each other on the respective rod longitudinally.

8. The leveling apparatus according to claim 5, further comprising:

a cleaning device is provided for the at least one of the sensors.

9. The leveling apparatus according to claim 5 wherein each sensor comprises mirrors, fiber optics, or hollow wave guides, and has electronic components arranged outside of the respective oven chamber to be filled during the operation of the leveling apparatus.

* * * * *